US005393944A

United States Patent [19]

Manandhar et al.

[11] Patent Number: 5,393,944

[45] Date of Patent: Feb. 28, 1995

[54] DECELERATION SWITCH WITH A SWITCH BASE SUPPORTING A FLEXIBLE OSCILLATING ONE PIECE PLASTIC MASS UNIT

[75] Inventors: Saroj Manandhar, Chino Hills; Long T. Su, West Covina, both of Calif.

[73] Assignee: TRW Technar Inc., Irwindale, Calif.

[21] Appl. No.: 243,253

[22] Filed: May 16, 1994

[51] Int. Cl.[6] ..... H01H 35/14

[52] U.S. Cl. ..... 200/61.45 R; 200/61.48; 200/61.49

[58] Field of Search ..... 200/61.45 R, 61.45 M, 200/61.48, 61.49, 61.5, 61.51, 61.52, 61.53

[56] References Cited

U.S. PATENT DOCUMENTS

| | | | |
|---|---|---|---|
| 2,850,291 | 9/1958 | Ziccardi | 280/735 |
| 2,902,292 | 9/1959 | Land | 280/735 |
| 3,489,917 | 1/1970 | Gurol | 307/121 |
| 3,639,710 | 2/1972 | Haruna et al. | 200/61.48 |
| 3,762,494 | 10/1973 | Peters | 280/735 |
| 4,020,302 | 4/1977 | Hasegawa et al. | 200/61.45 R |
| 4,221,940 | 9/1980 | Roth | 200/61.45 R |
| 4,262,177 | 4/1981 | Paxton et al. | 200/61.45 R |
| 5,155,307 | 10/1992 | Breed et al. | 200/61.45 R |
| 5,192,838 | 3/1993 | Breed et al. | 200/61.45 R |
| 5,231,253 | 7/1993 | Breed et al. | 200/61.45 R |
| 5,306,883 | 4/1994 | Manandhar et al. | 200/61.53 |

*Primary Examiner*—J. R. Scott

*Attorney, Agent, or Firm*—Tarolli, Sundheim & Covell

[57] ABSTRACT

A deceleration sensor switch (10) comprises a base (12) and a mass (20) pivotable from an unactuated position to an actuated position when the mass is subjected to deceleration of at least a predetermined magnitude. A support (18) supports the mass (20) on the base (12) to pivot from the unactuated position to the actuated position. The support (18) comprises a single continuous piece of plastic molded material having one rigid end (97) portion fixedly attached to the base (12) and an opposite rigid end (99) portion to which the mass (20) is fixedly attached. The single continuous piece of plastic molded material has a resilient central portion (98). The central portion (98) acts as a hinge about which the mass (20) is pivotable from the unactuated position to the actuated position. The opposite rigid end portions (97, 99) are inflexible relative to the resilient central portion (98). First and second electrical terminals (30, 34) move into engagement with each other to electrically close the switch (10) upon the mass (20) pivoting from the unactuated position to the actuated position.

15 Claims, 2 Drawing Sheets

DECELERATION SWITCH WITH A SWITCH BASE SUPPORTING A FLEXIBLE OSCILLATING ONE PIECE PLASTIC MASS UNIT

BACKGROUND OF THE INVENTION

1. Technical Field

The present invention relates to a deceleration sensor switch, and is particularly directed to a deceleration sensor switch comprising a mass pivotable from an unactuated position to an actuated position in response to a predetermined deceleration.

2. Background Art

Deceleration sensor switches which include a mass pivotable from an unactuated position to an actuated position in response to a predetermined deceleration are known. Some known deceleration sensor switches include a mass which pivots from an unactuated position to an actuated position in response to a predetermined deceleration to allow a contact to move into electrical contact with another contact. Some other known deceleration sensor switches include a mass which biases a contact away from another contact and which pivots from an unactuated position to an actuated position to allow the contacts to move into electrical contact with each other. Also, some of the known deceleration sensor switches have means for adjusting the responsiveness of the deceleration sensor switch.

SUMMARY OF THE INVENTION

In accordance with one aspect of the present invention, a deceleration sensor switch comprises a base and a mass. Support means is provided for pivotably supporting the mass on the base such that the mass can pivot from an unactuated position to an actuated position when the mass is subjected to deceleration of at least a predetermined magnitude. The support means comprises a single continuous piece of plastic molded material having a first rigid end portion fixedly attached to the base and a second rigid end portion to which the mass is fixedly attached. The single continuous piece of plastic molded material has a resilient central portion located between the first and second rigid end portions and acts as a hinge about which the mass is pivotable from the unactuated position to the actuated position. The first and second rigid end portions are inflexible relative to the resilient central portion. Means is provided for sensing when the mass is in the actuated position.

A first electrical terminal includes a first stem portion mounted on the base and a first spring portion extending from the first stem portion of the electrical terminal. A second electrical terminal includes a second stem portion mounted on the base and a second spring portion extending from the second stem portion of the electrical terminal. The first and second spring portions of the first and second electrical terminals move into engagement with each other to electrically connect the first and second electrical terminals upon the mass pivoting from the unactuated position to the actuated position.

Preferably, each of the first and second end portions of the single continuous piece of plastic molded material has a first thickness. The resilient central portion of the single continuous piece of plastic molded material has a second thickness which is less than the first thickness of each of the first and second end portions. A cover is engageable with the base to enclose the mass.

In accordance with another aspect of the present invention, a deceleration sensor switch comprises a base and first and second stops mounted on the base. A mass is located between the first and second stops and is movable along an arcuate path between the first and second stops from an unactuated position to an actuated position when the mass is subjected to deceleration of at least a predetermined magnitude. Support means is provided for supporting the mass on the base in a cantilevered fashion to enable the mass to move along the arcuate path from the unactuated position to the actuated position. The support means includes means for (i) continuously biasing the mass towards one of the first and second stops, and (ii) continuously biasing the mass against the one stop when the mass is in the unactuated position.

A first electrical terminal includes a first stem portion mounted on the base and a first spring portion extending from the first stem portion of the first electrical terminal. A second electrical terminal includes a second stem portion mounted on the base and a second spring portion extending from the second stem portion of the electrical terminal. The first and second spring portions of the first and second electrical terminals move into engagement with each other to electrically connect the first and second electrical terminals upon the mass moving along the arcuate path from the unactuated position to the actuated position.

One of the first and second spring portions is located between the mass and the other of the first and second spring portions and is movable into engagement with the other of the first and second spring portions to electrically connect the first and second electrical terminals upon the mass pivoting from the unactuated position to the actuated position. Also, preferably, the base and the first and second stops comprise a single continuous piece of plastic molded material.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
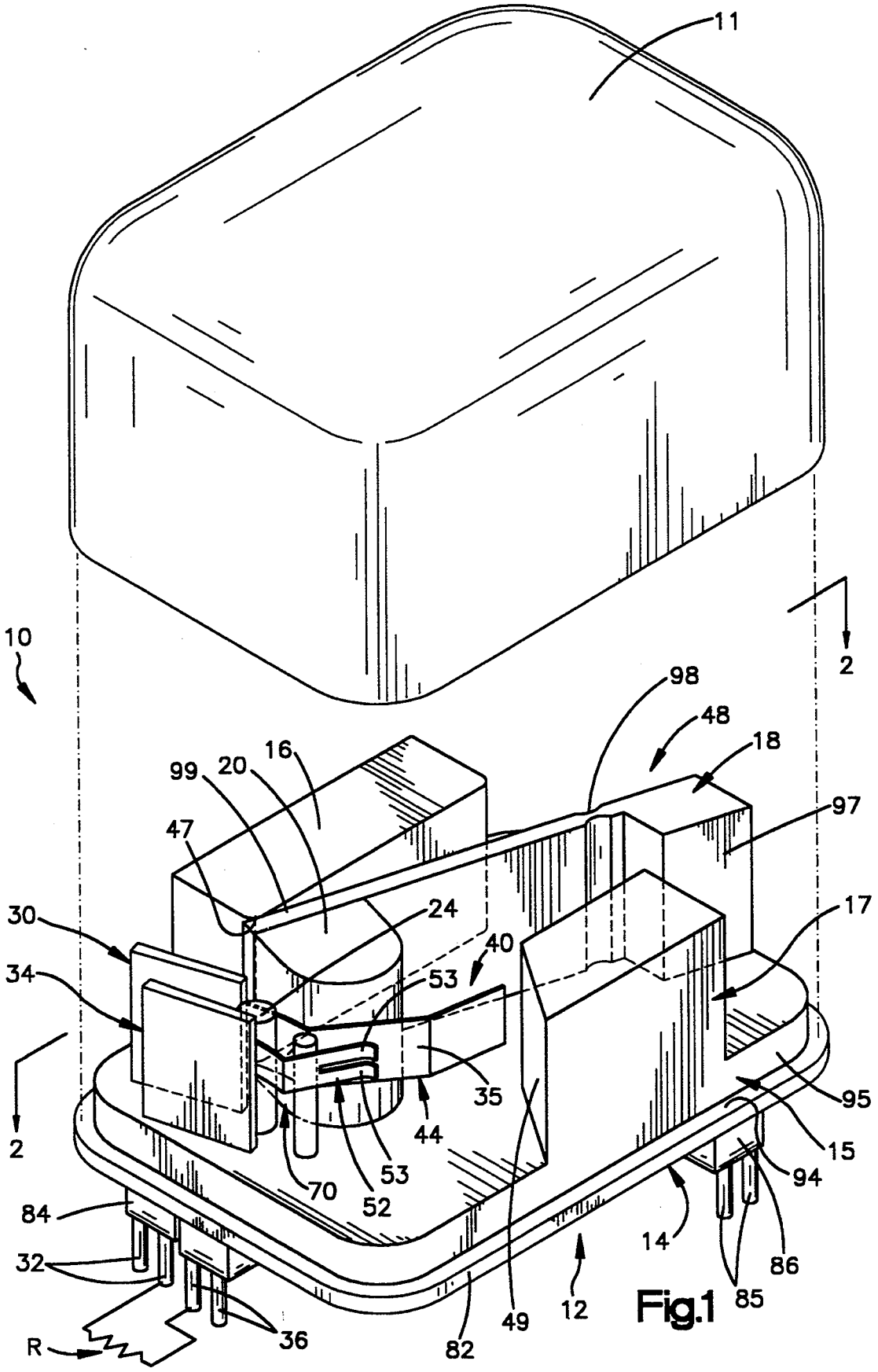
FIG. 1 is a perspective view of a deceleration sensor switch constructed in accordance with the present invention and looking at the switch at a given angle.

The present invention is directed to a deceleration sensor switch comprising a mass which pivots from an unactuated position to an actuated position in response to a predetermined acceleration. A deceleration sensor switch in accordance with the present invention may be used in a variety of different systems. Preferably, the deceleration sensor switch is particularly suited for use in a vehicle occupant safety system, such as an air bag system, to trigger inflation of an air bag in the event of vehicle deceleration indicative of a vehicle collision. A deceleration sensor switch 10 constructed in accordance with the present invention is shown in FIG. 1.

The deceleration sensor switch 10 comprises a base 12. The base 12 includes a bottom plate portion 14 and a top plate portion 15 located above the bottom plate portion 14. The bottom plate portion 14 lies in a flat plane. The top plate portion 15 lies in another flat plane which is parallel to the flat plane in which the bottom plate portion 14 lies. The bottom plate portion 14 has a main body part 82, a first terminal support part 84 located adjacent one end of the main body part 82, and a second terminal support part 86 located adjacent an opposite end of the main body part 82. The first and second terminal support parts 84, 86 project away from the main body part 82.

Figure 2:
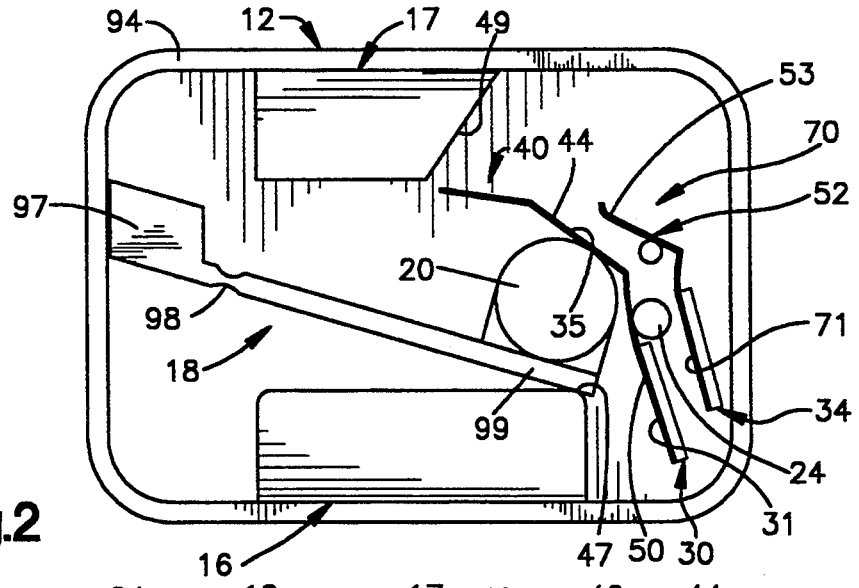
FIG. 2 is a view of the deceleration sensor switch of FIG. 1 as viewed in the direction along line 2—2 in FIG. 1.

As shown in FIGS. 1 and 2, the bottom plate portion 14 is larger than the top plate portion 15. The top plate portion 15 overlies part of the bottom plate portion 14 in such a way that a ledge 94 of uniform width is formed around the outer periphery of the base 12. The top plate portion 15 has a side wall 95 which extends around the outer periphery of the top plate portion 15. The side wall 95 extends perpendicular to the ledge 94. A cover 11 (shown only in FIG. 1) is sealingly engageable against the side wall 95 of the top plate portion 15 and the ledge 94 of the bottom plate portion 14 to seal and protect the deceleration sensor switch 10.

The base 12 further includes a first stop portion 16 located on the top plate portion 15 and a second stop portion 17 located on the top plate portion 15. Each of the first and second stop portions 16, 17 overlies part of the top plate portion 15. The first stop portion 16 has a stopping surface 47 and the second stop portion 17 has a stopping surface 49 which faces toward the stopping surface 47 of the first stop portion 16. A space 48 is defined between the first and second stop portions 15, 17.

The base 12 further includes a support structure 18 located on the top plate portion 15 and spaced apart from the first and second stop portions 16, 17. The support structure 18 comprises opposite end portions 97, 99 and a hinge portion 98 interconnecting the two opposite end portions 97, 99. The end portion 97 of the support structure 18 is located on the top plate portion 15. The hinge portion 98 has a thickness which is less than the thickness of either of the end portions 97, 99. The relatively smaller thickness of the hinge portion 98 provides the hinge portion 98 with some resilience upon the end portion 99 being bent relative to the end portion 97. The end portion 99 is thereby resiliently pivotable about the hinge portion 98 relative to the end portion 97. Preferably, the support structure 18, the first and second stop portions 16, 17, and the top and bottom plate portions 14, 15 comprise a single continuous piece of molded plastic material.

A cylindrically-shaped mass 20 is fixedly attached on its outer cylindrical surface to the end portion 99 of the support structure 18 and is movable with the end portion 99. A suitable adhesive (not shown), for example, may be used to fixedly attach the mass 20 to the end portion 99 of the support structure 18. The mass 20 is pivotable between an unactuated position shown in FIG. 2 and a fully actuated position shown in FIG. 4 along an arcuate path extending between the first and second stop portions 16, 17.

A terminal 30 made of a suitable electrical current conducting material, preferably stainless steel, is insert molded into the top plate portion 15, the bottom plate portion 14, and the first terminal support part 84 of the bottom plate portion 14. The terminal 30 has bifurcated leg portions 32 which extend away from the first terminal support part 84 of the bottom plate portion 14. One of the leg portions 32 is connectable to a negative terminal of a voltage supply and the other one of the leg portions 32 is connectable to an external resistor (R) for diagnostic purposes. The end of the terminal 30 opposite the leg portions 32 is one of a pair of electrical terminals of the deceleration sensor switch 10.

Another terminal 34 also made of a suitable electrical current conducting material, preferably stainless steel, is insert molded into the top plate portion 15, the bottom plate portion 14, and the first terminal support part 84 of the bottom plate 14. The terminal 34 has bifurcated leg portions 36 which extend away from the first terminal support part 84 of the bottom plate portion 14. One of the leg portions 36 is connectable to a positive terminal of a voltage supply and the other one of the leg portions 36 is connectable to the other end of the external resistor (R) for diagnostic purposes. The end of the terminal 34 opposite the leg portions 36 is the other one of the pair of electrical terminals of the deceleration sensor switch 10. It will be noted that resistor (R) bridges the contacts of the switch and therefore provides a relatively high resistance current path across the switch even when the switch is in its normal, open position.

A pair of leg portions 85 are insert molded into the second terminal support part 86. The leg portions 85 extend away from the second terminal support part 86 in the same direction as the leg portions 32 of the terminal 30 and the leg portions 36 of the terminal 34 extend away from the first terminal support part 84. The three leg portions 32, 36, 85 support the deceleration sensor switch 10 when the deceleration sensor switch 10 is mounted for use.

Figure 3:
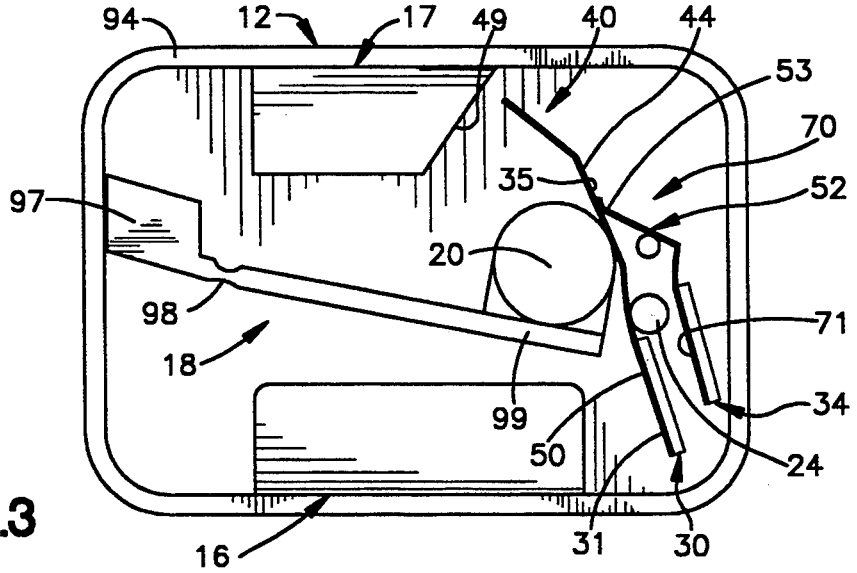
FIG. 3 is a view similar to FIG. 2 but showing parts of the deceleration sensor switch in other positions.
Figure 4:
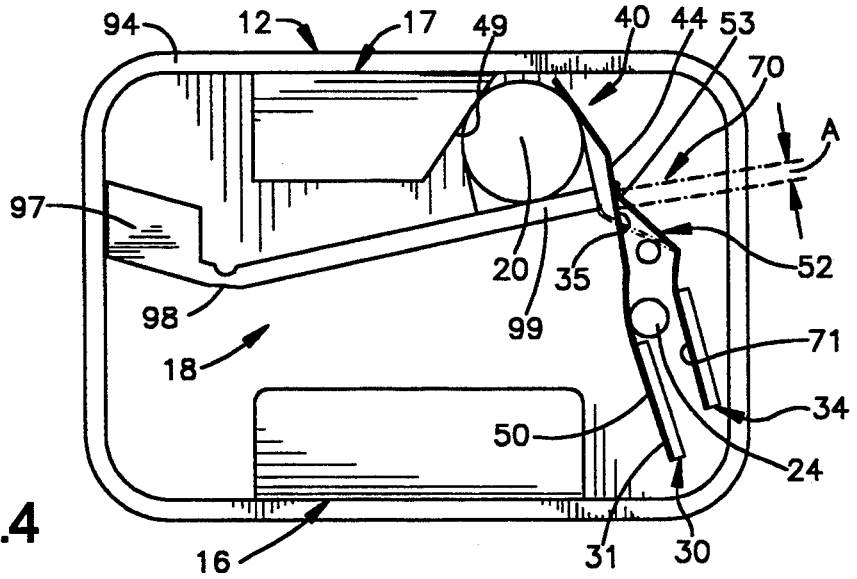
FIG. 4 is a view similar to FIG. 3 but showing parts of the deceleration sensor switch in still other positions.

A first contact 40, made of stainless steel, includes a strip portion 44 and an end portion 50 (see FIGS. 2–4). The end portion 50 is welded to a flat surface 31 of the terminal 30 so that the strip portion 44 of the first contact 40 extends horizontally, as viewed in FIG. 1. The strip portion 44 acts as a leaf spring to provide a spring-like force to the first contact 40. A second contact 70 has a contact portion 52 and an end portion 71. The contact portion 52 has a pair of spring-like fingers 53 (best shown in FIG. 1) which are contactable with a surface 35 on the strip portion 44 of the first contact 40.

An adjustable calibration member 24 in the form of a cam-shaped insert is located adjacent the strip portion 44 of the first contact 40. The position of the cam-shaped insert 24 relative to the strip portion 44 can be adjusted to adjust the initial spring force exerted by the strip portion 44 of the first contact 40 against the mass 20.

When the fingers 53 of the contact portion 52 of the second contact 70 are not contacting the surface 35 on the strip portion 44 of the first contact 40, the first contact 40 and the second contact 70 are not electrically connected. The deceleration sensor switch 10 is then in a fully open condition, as shown in FIG. 2. When the deceleration sensor switch 10 is in the fully open condition shown in FIG. 2, the end 99 of the support structure 18 abuts the stopping surface 47 of the first stop portion 16 so as to permit the fingers 53 of the second contact 70 to remain spaced apart from the surface 35 of the first contact 40.

When the deceleration sensor switch 10 is subjected to deceleration of a predetermined magnitude, as would occur in a vehicle collision, the mass 20 pivots about the hinge portion 98 of the support structure 18 and moves along an arcuate path extending between the first and second stop portions 16, 17 against the resilient bias of the hinge portion 98 of the support structure 18. As the mass 20 moves along the arcuate path, the mass 20 moves away from the stopping surface 47 of the first stopping portion 16. The mass 20 forces the strip portion 44 of the first contact 40 to flex towards the contact portion 52 of the second contact 70 (as viewed in FIGS. 2–4). As the mass 20 proceeds along its arcuate path, the strip portion 44 of the first contact 40 continues to move toward the contact portion 52 of the second contact 70 until the surface 35 of the first contact 40 moves into initial engagement with the fingers 53 of the second contact 70, as shown in FIG. 3. When the first and second contacts 40, 70 are in their initial engagement position shown in FIG. 3 and initial electrical contact is established between the terminal 34 and the terminal 30, the mass 20 is in an actuated position and the deceleration sensor switch 10 is in an initial closed condition.

Thereafter, as the mass 20 continues along its arcuate path towards the second stop portion 17, the electrical contact established between the first and second contacts 40, 70 is maintained due to the spring-like resilience of the strip portion 44 and the contact portion 52. The mass 20 continues to move towards the second stop portion 17 until the mass 20 engages the stopping surface 47 of the second stop portion 17, as shown in FIG. 4. When the mass 20 engages the stopping surface 47, the mass 20 is in its fully actuated position and the first and second contacts 40, 70 are in a final engagement position. The deceleration sensor 10 is thus in a fully closed condition.

During the continued movement of the mass 20 towards the second stop portion 17, the fingers 53 of the second contact 70 wipe (slide) across the surface 35 of the first contact 40. The fingers 53 continue to wipe across the surface 35 until they reach their final engagement position, as shown in FIG. 4.

During their wiping movement from their initial engagement position shown in FIG. 3 to their final engagement position shown in FIG. 4, the fingers 53 of the contact portion 52 move a certain distance (designated with reference letter A in FIG. 4) across the surface 35. The distance A is relatively small, but is exaggerated in FIG. 4 for purposes of illustration. Electrical contact between the terminal 34 and the terminal 30 is maintained during the wiping movement.

By allowing the fingers 53 to wipe across the surface 35, the reliability of the electrical contact established between the terminal 34 and the terminal 30 is enhanced. The reliability enhancement arises because the wiping action helps to displace any small particles which may have come to rest between the surface 35 and the fingers 53. Also, the rubbing action which arises from the wiping motion helps to penetrate any oxides, corrosion, or other non-conducting film which may be present on the contact areas and thereby re-establish good electrical contact between the areas.

As the deceleration forces which caused the movement of the mass 20 to its fully actuated position dissipate, the resilience of the hinge portion 98 causes the mass 20 to move from the fully actuated position shown in FIG. 4 back toward the unactuated position shown in FIG. 2. The mass 20 continues to move toward the unactuated position shown in FIG. 2 until the end 99 of the support structure 18 returns to a resting position in engagement with the stopping surface 47 of the first stopping portion 16.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A deceleration sensor switch comprising:

a base;

a mass;

support means for supporting said mass on said base such that said mass can pivot from an unactuated position to an actuated position when said mass is subjected to deceleration of at least a predetermined magnitude, said support means comprising a single continuous piece of plastic molded material having a first rigid end portion fixedly attached to said base and a second rigid end portion to which said mass is fixedly attached, said single continuous piece of plastic molded material having a resilient central portion located between said first and second rigid end portions and acting as a hinge about which said mass is pivotable from said unactuated position to said actuated position, said first and second rigid end portions being inflexible relative to said resilient central portion; and means for sensing when said mass is in said actuated position.

2. A deceleration sensor switch according to claim 1 further comprising a first stop against which said mass and said first end portion of said single continuous piece of plastic molded material are biased by said resilient central portion of said single continuous piece of plastic molded material when said mass is in said unactuated position.

3. A deceleration sensor switch according to claim 2 further comprising a second stop which limits the extent of movement of said mass when said mass moves from said unactuated position to said actuated position.

4. A deceleration sensor switch according to claim 3 wherein said mass is located between said first and second stops and is pivotable about said resilient central portion along an arcuate path extending between said first and second stops.

5. A deceleration sensor switch according to claim 3 wherein said base and said first and second stops comprise a single continuous piece of plastic molded material.

6. A deceleration sensor switch according to claim 1 wherein said sensing means comprises (i) a first electrical terminal including a first stem portion mounted on said base and a first spring portion extending from said first stem portion of said first electrical terminal, and (ii) a second electrical terminal including a second stem portion mounted on said base and a second spring portion extending from said second stem portion of said electrical terminal, said first and second spring portions of said first and second electrical terminals moving into engagement with each other to electrically connect said first and second electrical terminals upon said mass pivoting from said unactuated position to said actuated position.

7. A deceleration sensor switch according to claim 6 wherein one of said first and second spring portions is located between said mass and the other one of said first and second spring portions and is movable into engagement with the other one of said first and second spring portions to electrically connect said first and second electrical terminals upon said mass pivoting from said unactuated position to said actuated position.

8. A deceleration sensor switch according to claim 7 further comprising means for adjusting the stiffness of said one spring portion located between said mass and said other spring portion.

9. A deceleration sensor switch according to claim 1 wherein each of said first and second end portions of said single continuous piece of plastic molded material has a first thickness, and said resilient central portion of said single continuous piece of plastic molded material has a second thickness which is less than said first thickness of each of said first and second end portions.

10. A deceleration sensor switch according to claim 1 further comprising a cover engageable with said base and for, when engaged with said base, enclosing said mass and said first and second stopping portions.

11. A deceleration sensor switch comprising:

a base;

first and second stops mounted on said base;

a mass located between said first and second stops;

support means constraining freedom of movement of said mass and for supporting said mass in a cantilevered fashion on said base such that said mass can move along an arcuate path between said first and second stops from an unactuated position to an actuated position when said mass is subjected to deceleration of at least a predetermined magnitude, said support means including means for (i) continuously biasing said mass towards one of said first and second stops, and (ii) continuously biasing said mass against said one stop when said mass is in said unactuated position; and means for sensing when said mass is in said actuated position.

12. A deceleration sensor switch according to claim 11 wherein said sensing means comprises (i) a first electrical terminal including a first stem portion mounted on said base and a first spring portion extending from said first stem portion of said first electrical terminal, and (ii) a second electrical terminal including a second stem portion mounted on said base and a second spring portion extending from said second stem portion of said electrical terminal, said first and second spring portions of said first and second electrical terminals moving into engagement with each other to electrically connect said first and second electrical terminals upon said mass moving along said arcuate path from said unactuated position to said actuated position.

13. A deceleration sensor switch according to claim 12 wherein one of said first and second spring portions is located between said mass and the other one of said first and second spring portions and is movable into engagement with the other one of said first and second spring portions to electrically connect said first and second electrical terminals upon said mass pivoting from said unactuated position to said actuated position.

14. A deceleration sensor switch according to claim 13 further comprising means for adjusting the stiffness of said one spring portion located between said mass and said other spring portion.

15. A deceleration sensor switch according to claim 11 wherein said base and said first and second stops comprise a single continuous piece of plastic molded material.

* * * * *